United States Patent [19]

Wood

[11] Patent Number: 4,887,008

[45] Date of Patent: Dec. 12, 1989

[54] ELECTRODELESS LAMP BULB OF MODIFIED SHAPE FOR PROVIDING UNIFORM EMISSION OF RADIATION

[75] Inventor: Charles H. Wood, Rockville, Md.

[73] Assignee: Fusion Systems Corporation, Rockville, Md.

[21] Appl. No.: 186,657

[22] Filed: Apr. 19, 1988

Related U.S. Application Data

[63] Continuation of Ser. No. 736,580, May 21, 1985, abandoned.

[30] Foreign Application Priority Data

Jun. 14, 1984 [JP] Japan ..... 59-120873

[51] Int. Cl.[4] ..... H01J 7/00

[52] U.S. Cl. ..... 315/39; 313/634; 250/504 R; 315/248

[58] Field of Search ..... 315/39, 248; 313/634, 313/493, 639; 250/492.2, 504 R

[56] References Cited

U.S. PATENT DOCUMENTS

| | | | |
|---|---|---|---|
| 3,873,884 | 3/1975 | Gabriel | 315/267 |
| 3,942,058 | 3/1976 | Haugsjaa et al. | 315/248 |
| 3,942,068 | 3/1976 | Haugsjaa et al. | 315/39 |
| 4,065,701 | 12/1977 | Haugsjaa et al. | 315/248 |
| 4,206,387 | 6/1980 | Kramer et al. | 315/248 |
| 4,298,828 | 11/1981 | Justice et al. | 315/248 |
| 4,427,920 | 1/1984 | Proud et al. | 315/248 |
| 4,507,587 | 3/1985 | Wood et al. | 315/39 |
| 4,532,427 | 7/1985 | Matthews et al. | 315/248 |

FOREIGN PATENT DOCUMENTS 59-18502 1/1984 Japan .

*Primary Examiner*—Robert L. Griffin
*Assistant Examiner*—T. Salindong
*Attorney, Agent, or Firm*—Pollock, Vande Sande & Priddy

[57] ABSTRACT

An electrodeless lamp bulb of modified shape for providing more uniform emission of radiation. In the preferred embodiment the bulb is primarily in the shape of a sphere, but has at least a non-spherical portion comprised of diametrically opposed relatively flattened portions.

A microwave generated electrodeless lamp which incorporates the improved bulb provides more spatially uniform radiation at an illumination plane.

3 Claims, 1 Drawing Sheet

ELECTRODELESS LAMP BULB OF MODIFIED SHAPE FOR PROVIDING UNIFORM EMISSION OF RADIATION

This application is a continuation of application Ser. No. 736,580, filed May 21, 1985, now abandoned.

The present invention is directed to an improved microwave generated electrodeless lamp which provides more spatially uniform radiation at a plane, and to an improved lamp bulb, which when used in said lamp results in said more uniform radiation.

Microwave generated electrodeless lamps are now well known and in general comprise a microwave chamber made of a reflector and a mesh, in which a lamp bulb containing a plasma forming medium is disposed. The reflector is opaque to microwaves but reflective as to ultraviolet and the mesh is opaque to microwaves but transparent to ultraviolet. Thus, when microwave energy is fed to the chamber, a plasma is excited in the bulb which emits ultraviolet radiation, which is reflected by the reflector out of the mesh and onto the target to be irradiated.

For many applications, for example for area illumination of photographic plates, it is important for the intensity of the radiation to be spatially uniform across the surface which is being illuminated. A prior area illumination lamp which provides relatively uniform radiation is disclosed in Japanese Patent Application Nos. 39719/84 and 39720/84 as well as in corresponding U.S. patent application No. 707,159.

In the prior lamp, a spherical bulb is used, and the design of the reflector is such to ideally reflect spatially uniform radiation onto the target plane under the assumption that the electrodeless bulb used is a spherical volume source which radiates ultraviolet radiation of uniform intensity in all radial directions. However, it has been discovered that because of the lack of uniformity of the electromagnetic field in the volume of the bulb, the radiation emitted is weaker in certain directions, which has caused non-uniformities in the radiation which is reflected onto the target.

The present invention comprises modifying the shape of an electrodeless lamp bulb so as to dispose a greater proportion of the plasma forming substance with which the bulb is filled in a relatively uniform, relatively high strength electromagnetic field portion in the microwave chamber. Thus, in accordance with the invention, an electrodeless lamp bulb of arbitrary shape is provided, such that it emits ultraviolet radiation of relatively uniform intensity in all directions when inserted in a microwave chamber in which there exists when operative, an electromagnetic field which is not of spatially uniform strength.

In the preferred embodiment the bulb is primarily of spherical shape but has at least a non-spherical portion, specifically, diametrically opposed relatively flattened portions. When the bulb of the preferred embodiment is used in the prior art lamp, the uniformity of the radiation incident on a plane is improved from a uniformity figure of merit of 12–15% to a uniformity figure of merit of about 9–11%.

It is thus an object of the invention to provide an improved electrodeless lamp bulb, which is capable of emitting more spatially uniform radiation.

It is a further object of the invention to provide an improved microwave generated electrodeless lamp, which provides more spatially uniform radiation on a plane.

The invention will be better understood by referring to the accompanying drawings, in which:

FIG. 2 is a perspective view, and also illustrates the cross-sectional shape of the chamber of FIG. 1.

Figure 1:
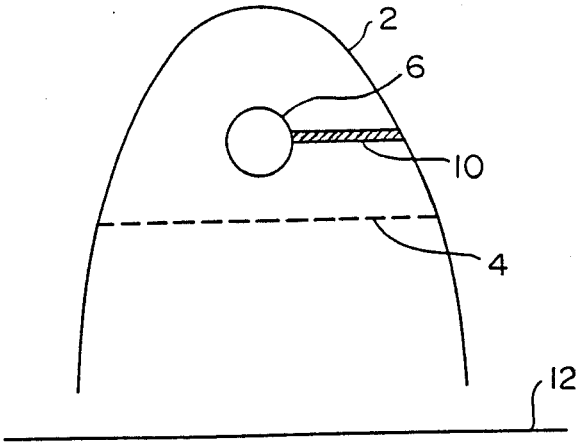
FIG. 1 is a schematic illustration of a prior lamp, using a prior art electrodeless bulb.

Referring to FIG. 1, a prior area illumination electrodeless lamp, as depicted in Japanese Patent Application Nos. 39719/84 and 39720/84 is shown. The lamp is comprised of a microwave chamber made up of reflector 2 and mesh 4, in which a lamp bulb 6 of spherical shape is disposed. A microwave coupling slot is disposed at about bulb height at the back of the reflector, that is 90° removed from the bulb stem 10 moving around the reflector into the plane of the paper. When microwave energy is fed into the slot, an electromagnetic field propagates in the chamber, and excites a plasma in bulb 6, which emits ultraviolet radiation. The radiation is reflected by reflector 2 out of mesh 4 and onto target plane 12.

Reflector 2 is designed to provide spatially uniform radiation on the target plane, provided that bulb 6 radiates uniformly in all radial directions. However, it has been determined that this is not the case, and as a result the radiation provided at target plane 12 lacks the desired uniformity.

Figure 2:
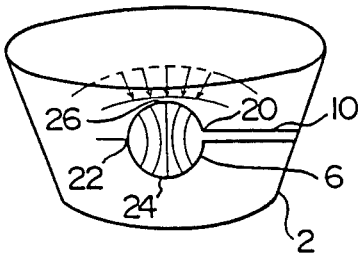
FIG. 2 is a schematic illustration, which depicts electric field lines which may be present in the configuration illustrated in FIG. 1, although other modes could be present.

The reason that bulb 6 does not radiate uniformly is that the electromagnetic field is not of uniform strength throughout the interior of the bulb volume. The electric component of the field, which is illustrated in FIG. 2, is in predominantly one direction. This may cause the field strength at bulb portions 20 and 22 to be less than the field strength at portions 24 and 26, thereby causing ultraviolet emission at portions 20 and 22 to be smaller.

In accordance with the invention, it has been found that the emission characteristics of portions of an electrodeless lamp bulb may be varied by locally altering the shape of the bulb, and that the output may be made more uniform by changing the bulb shape such that a greater proportion of the plasma forming substance in the bulb is disposed in a relatively uniform electromagnetic field portion in the microwave chamber. In connection with the specific lamp shown in FIGS. 1 and 2, it has been found that by relatively flattening bulb portions 20 and 22, light emission therefrom is increased, and the bulb radiates more uniformly.

Figure 3:
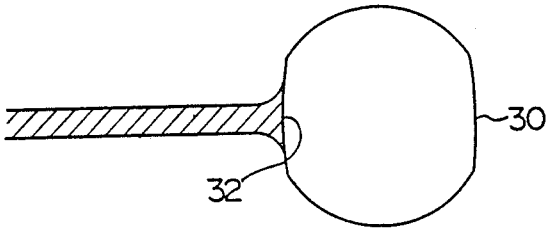
FIG. 3 is a schematic illustration of an embodiment of the lamp bulb of the invention.
Figure 4:
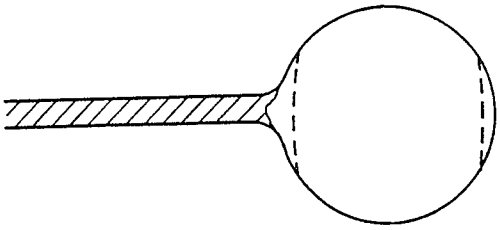
FIG. 4 is an illustration which depicts the shape of the bulb of FIG. 3 as compared with a bulb of spherical shape.

A bulb in accordance with such embodiment of the invention is depicted in FIG. 3, wherein relatively flattened portions 30 and 32 are provided. In FIG. 4, the shape of the bulb is shown as compared with the spherical shape of the prior art bulb.

As mentioned above, it appears that the bulb shape shown in FIG. 3 causes increased emission from bulb portions 30 and 32 because it disposes a greater proportion of the bulb fill within a region of stronger electromagnetic field, as compared to the prior arrangement shown in FIGS. 1 and 2.

The improved bulb and lamp of the present invention results in a substantial increase in lamp uniformity. Thus, in comparative tests performed, where a figure of merit for uniformity is defined as (Max I − Min I)/(Max I + Min I) where I is the intensity of illumination on the target plane, the lamp of the present invention resulted in a uniformity of ±9–11% as opposed to ±12–15% for the prior arrangement.

In an actual production bulb which will be utilized, the bulb is a sphere having an outside diameter of approximately 1.2" and having a shortened axis (30–32 in FIG. 3) of approximately 1". The bulb fill is comprised of Hg, $FeI_3$, and argon, and the bulb is disposed in a microwave chamber of the general shape shown in FIGS. 1 and 2 having a dimension of 3" from screen 4 to the top of reflector 2 and a circular screen 4 having a diameter of 5.6". Microwave energy is supplied at a frequency of 2.45 Ghz.

Thus, a way of modifying electrodeless lamp bulbs to provide more uniform radiation, as well as an improved electrodeless lamp bulb and lamp capable of providing radiation have been disclosed. While the invention has been described in connection with an illustrative embodiment, it should be appreciated that variations in the shapes of bulbs in accordance with the teachings of the invention will occur to those skilled in the art, and the invention is to be limited only by the claims appended hereto and equivalents.

I claim:

1. A microwave generated electrodeless lamp comprising, microwave energy generating means, a microwave chamber which includes a mesh through which radiant energy exits the lamp, means for coupling microwave energy from said generating means to said chamber such that there is set up in said chamber an electromagnetic field having a relatively uniform electric field portion and other electric field portions having a different strength than said relatively uniform electric field portion, and an electrodeless lamp bulb disposed in said chamber which is filled with material which forms a plasma when ionized and which has the shape of a sphere having two opposed relatively flattened portions which face each other, said lamp bulb being positioned in said chamber so that its volume encompasses substantially only said relatively uniform electric field portion and such that other field portions of different strength than said relatively uniform portion lie outside said bulb adjacent said relatively flattened portions.

2. An electrodeless lamp bulb comprised of a single ultraviolet transmissive envelope which is primarily in the shape of a sphere, which has two diametrically opposed relatively flattened portions, and which is filled with a substance which forms a plasma when ionized.

3. A method of improving the uniformity with which an electrodeless lamp emits radiation wherein the lamp includes an electrodeless lamp bulb comprised of an envelope of initial shape which is filled with a substance which forms a plasma when ionized and which is for insertion in a microwave chamber in which when operative there exists an electromagnetic field having a relatively uniform electric field portion and a field portion which is contiguous with said relatively uniform field portion and which has a different strength than said relatively uniform portion at a position such that a portion of the bulb envelope is adjacent said contiguous field portion and the center of the bulb is at a predetermined position in said chamber, comprising the steps of, changing said initial shape of the bulb envelope by making smaller said envelope portion which is adjacent said contiguous field portion so that a greater proportion of the plasma forming substance in said bulb will be located in said relatively uniform field portion when the bulb is inserted in the chamber with the center of the bulb at said predetermined position, and inserting the bulb in the chamber with its center at said predetermined position.

* * * * *